US010993558B2

(12) United States Patent
Jones et al.

(10) Patent No.: US 10,993,558 B2
(45) Date of Patent: May 4, 2021

(54) TABLE COVER SYSTEM WITH AFFIXED GARBAGE BAG

(71) Applicants: James P. Jones, Ripley, MS (US); Jackie L. McKenzie, Ripley, MS (US); Shadrach Spight, Ripley, MS (US)

(72) Inventors: James P. Jones, Ripley, MS (US); Jackie L. McKenzie, Ripley, MS (US); Shadrach Spight, Ripley, MS (US)

( * ) Notice: Subject to any disclaimer, the term of this patent is extended or adjusted under 35 U.S.C. 154(b) by 0 days.

(21) Appl. No.: 16/580,709

(22) Filed: Sep. 24, 2019

(65) Prior Publication Data

US 2020/0093298 A1 Mar. 26, 2020

Related U.S. Application Data

(60) Provisional application No. 62/735,532, filed on Sep. 24, 2018.

(51) Int. Cl.
*A47G 11/00* (2006.01)
*B65F 1/00* (2006.01)
*A47B 37/00* (2006.01)

(52) U.S. Cl.
CPC ..... *A47G 11/003* (2013.01); *A47B 37/00* (2013.01); *B65F 1/0006* (2013.01)

(58) Field of Classification Search
CPC ..... A47C 31/10; B65D 25/34; A47G 11/003; A47G 11/004; B65F 1/0006
USPC ..... 108/90, 25; 150/158
See application file for complete search history.

(56) References Cited

U.S. PATENT DOCUMENTS 54,390 A * 5/1866 Munson ..... A47B 13/08 108/90
1,535,895 A * 4/1925 Blackmore ..... A47B 25/00 273/309
1,587,387 A * 6/1926 Lichtman ..... A47G 11/003 108/90
3,939,976 A * 2/1976 VanIseghem, Jr. .... A47G 11/00 206/390
4,177,846 A * 12/1979 Rountree ..... A45F 3/46 108/90
4,471,600 A * 9/1984 Dunleavy ..... B65B 67/1238 15/257.7
4,542,050 A * 9/1985 Gallant ..... A47G 11/003 108/90
4,750,402 A * 6/1988 Markey ..... G10G 7/005 108/90
4,938,607 A * 7/1990 Kelley ..... B65D 31/00 190/1

(Continued)

*Primary Examiner* — Jose V Chen
(74) *Attorney, Agent, or Firm* — Law Office of Mark Brown, LLC; Christopher M. DeBacker

(57) ABSTRACT

A table cover system with an affixed garbage bag on one end. The table cover can be unrolled onto a table top with the garbage bag unrolled on one end of the cover. This allows for rubbish to be easily and quickly disposed of from the top of the table. The table cover can also be rolled over all remaining rubbish and garbage and stuffed into the garbage bag for easy disposal. The top face of the table cover can include printed elements, such as interactive games, team logos, or icons or characters from popular movies and television. Other options would include menus, schedules, or meeting information which may be printed directly to the table cover or attached after the cover is placed.

15 Claims, 7 Drawing Sheets

(56) References Cited

U.S. PATENT DOCUMENTS 5,055,081 A * 10/1991 Nayak ..... A63H 33/04 108/26
5,069,554 A * 12/1991 Bonnett ..... A47G 11/003 108/90
5,284,099 A * 2/1994 Cohen ..... A47G 11/007 108/90
5,506,019 A * 4/1996 Abeyta ..... A47G 11/007 108/165
5,609,933 A * 3/1997 Stepanek ..... A47G 27/0206 108/90
5,709,477 A * 1/1998 Schinasi ..... B65F 1/00 383/4
5,776,572 A * 7/1998 Lipson ..... B05B 12/24 428/40.1
6,116,167 A * 9/2000 Rabe ..... G09F 23/06 108/27
6,431,089 B1 * 8/2002 O'Brien ..... A47G 11/006 108/90
6,508,183 B2 * 1/2003 Kerrigan ..... A47G 11/003 108/90
7,785,008 B2 * 8/2010 Schoenig ..... B65F 1/0006 294/214
8,117,971 B1 2/2012 Cotton et al.
8,196,528 B2 * 6/2012 Jones ..... A47G 11/006 108/90
8,789,476 B1 * 7/2014 Kryman ..... A47G 19/03 108/90
10,448,767 B1 * 10/2019 Williams ..... G09F 23/08
2004/0028853 A1 * 2/2004 Jackson ..... A47G 11/003 428/35.5
2006/0207482 A1 * 9/2006 Bridge ..... A47B 13/08 108/90
2010/0132595 A1 * 6/2010 Gledhill ..... A47G 11/003 108/90

* cited by examiner

TABLE COVER SYSTEM WITH AFFIXED GARBAGE BAG

CROSS-REFERENCE TO RELATED APPLICATION

This application claims priority in U.S. Provisional Patent Application No. 62/735,535 Filed Sep. 24, 2018, which is incorporated herein by reference.

BACKGROUND OF THE INVENTION

1. Field of the Invention

The present invention relates generally to a table cover system and method for use thereof, and more specifically to a disposable table cover with an affixed garbage bag for easy disposal.

2. Description of the Related Art

During parties and other events where many people are present, disposable dinner ware and table covers are often used. However, a separate waste disposal receptacle is required and objects must be individually picked up and transported to the disposal receptacle.

Heretofore there has not been available a system or method for a table cover system with the advantages and features of the present invention.

BRIEF SUMMARY OF THE INVENTION

The present invention generally provides a table cover system with an affixed garbage bag on one end. The table cover can be unrolled onto a table top with the garbage bag unrolled on one end of the cover. This allows for rubbish to be easily and quickly disposed of from the top of the table. The table cover can also be rolled over all remaining rubbish and garbage and stuffed into the garbage bag for easy disposal.

The top face of the table cover can include printed elements, such as interactive games, team logos, or icons or characters from popular movies and television. Other options would include menus, schedules, or meeting information which may be printed directly to the table cover or attached after the cover is placed.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Table Cover System 2

Figure 1:
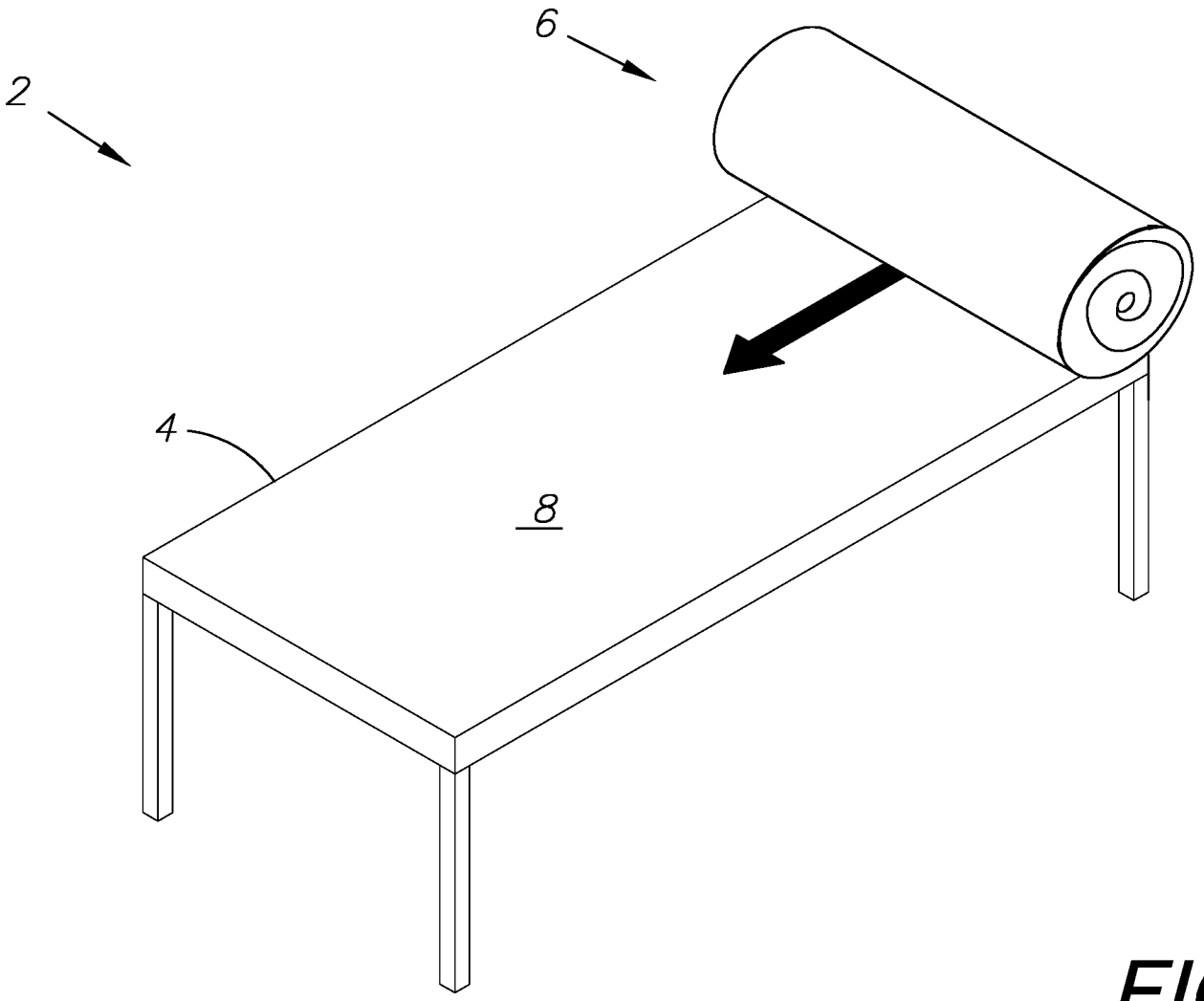
FIG. 1 is a three-dimensional isometric view of a table environment where a preferred embodiment of the present invention is shown in an un-deployed orientation.
Figure 2:
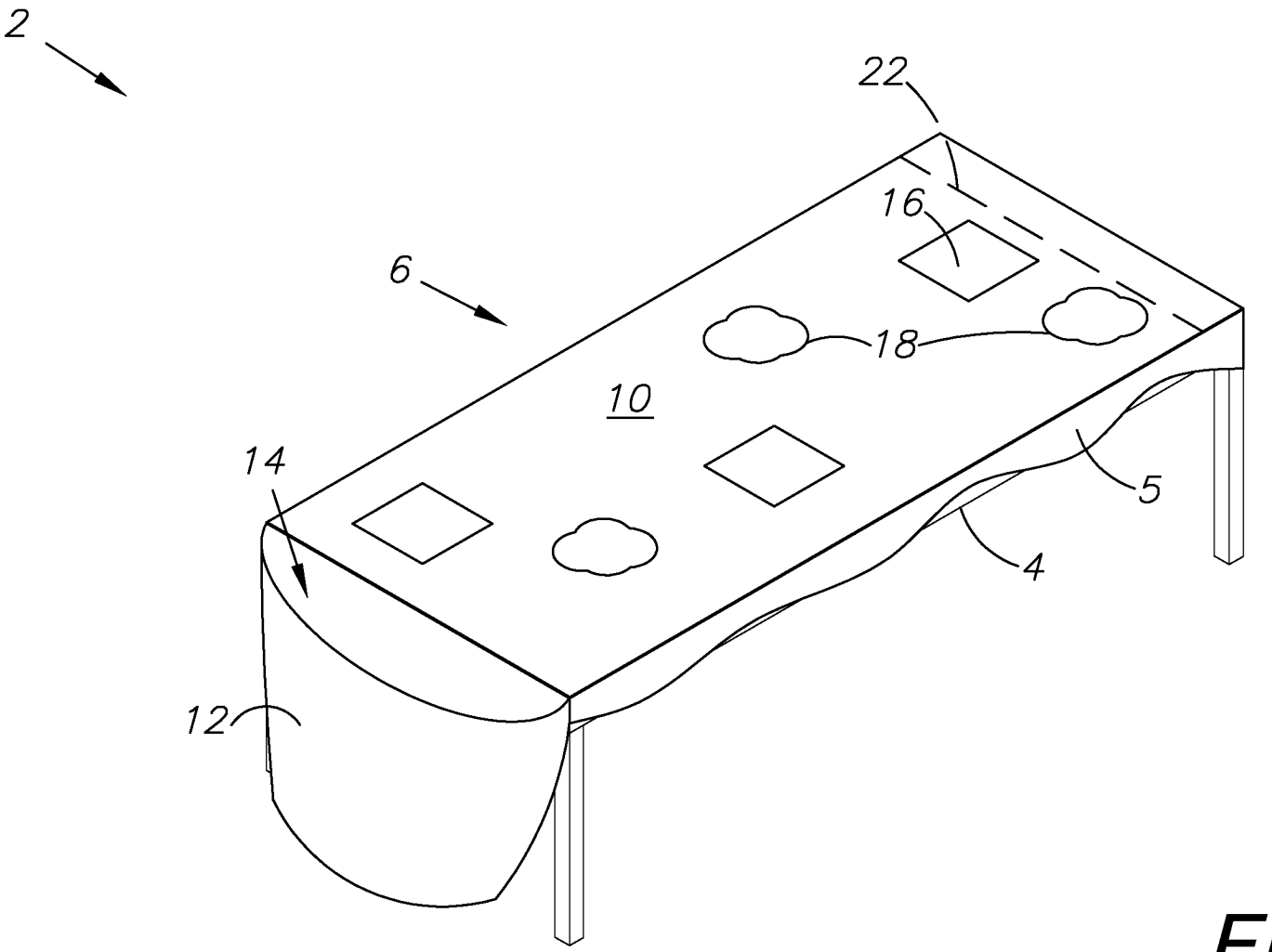
FIG. 2 is a three-dimensional isometric view thereof shown in a deployed orientation with the bag element deployed to one end and including decorative elements on a table cover element.

FIG. 1 shows a table cover system 2 which shows a table 4 with a top surface 8 and an undeployed table cover 6 being rolled out or otherwise deployed onto the top surface 8 of the table 2. FIG. 2 shows the cover 6 deployed on the top face of the table 4 with a refuse bag 12, attached to an end of the cover 6 and made of the same material as the cover surface 10. The refuse bag 12 and cover surface 10 of the cover 6 are all manufactured from the same material and are permanently affixed, so that when the cover 6 is unrolled or otherwise deployed, the refuse bag element 12 falls off to one side of the table 4. The overhanging side flaps 5 secure the table cover system 2 to the top of the table.

As further shown in FIG. 2, decorative elements 18 are included on the top face 10 of the cover element 6. These decorative elements 18 can include 2D or 3D printed interactive games, team logos, or other decorations including characters from television or movies. Customized printed table covers could also include custom-made displays for personalized events, including birthdays, weddings, and graduations. Printed elements 16, including schedules, menus, or other text-based information can be printed onto the top face 10 of the cover element 6 as well, or may be affixed after the cover element is deployed. Perforations 22 or other devices for selectively shortening the cover element 6 to fit the table 4 may also be used, or the cover element may be selectively shortened using scissors or by other means.

Figure 3:
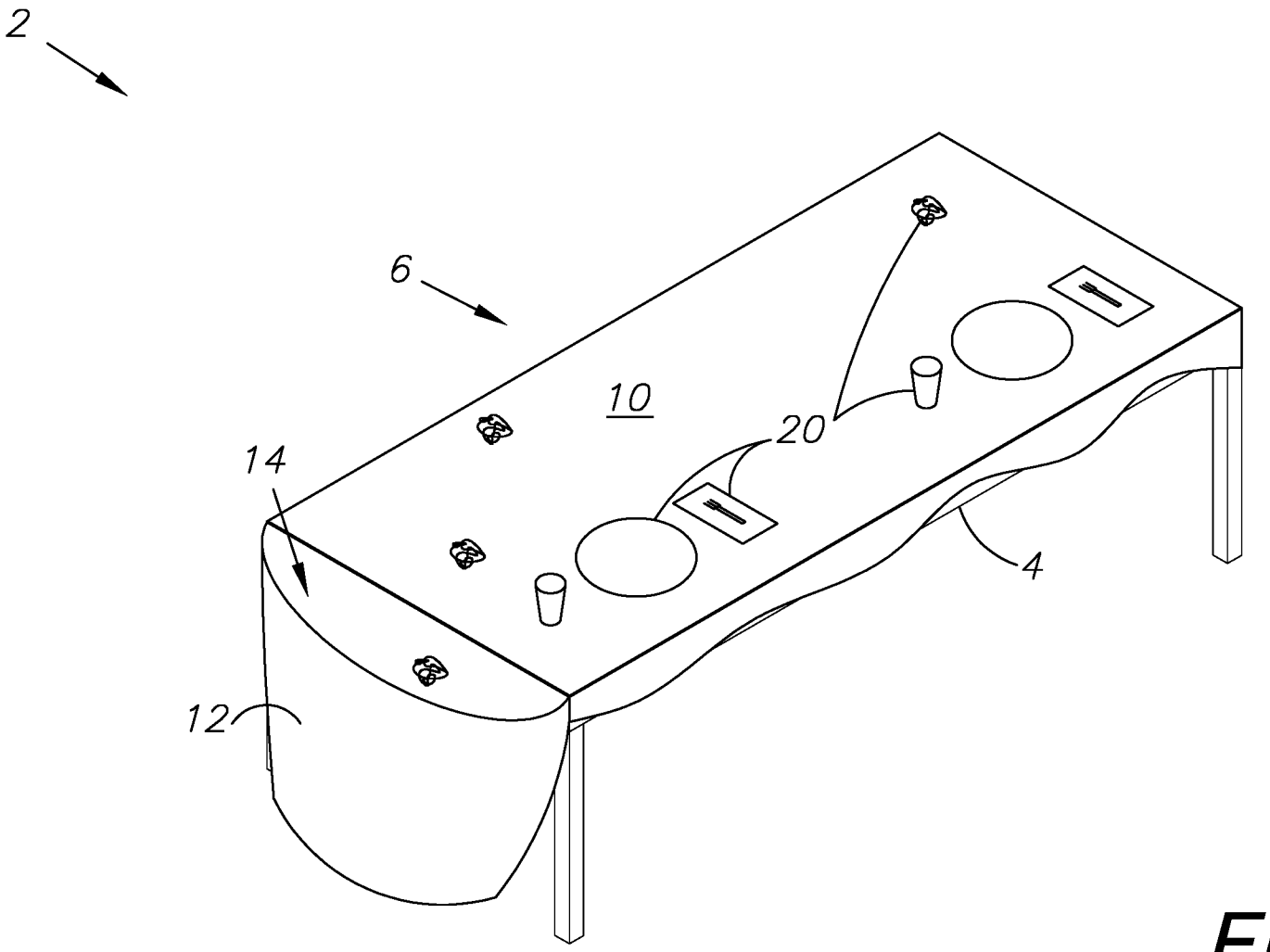
FIG. 3 is a three-dimensional isometric view thereof shown in a deployed orientation with the bag element deployed to one end and rubbish and dining items deployed on the top surface of the table cover element.

FIG. 3 shows the cover 6 deployed onto the table 4 with the refuse bag 12 located on the end. Dining items and refuse 20 are placed atop the top face 10 of the cover element 6 for use in dining or for other purposes. An opening 14 in the refuse bag 12 allows for the dining items and refuse 20 to be placed into the refuse bag when no longer in use.

Figure 4:
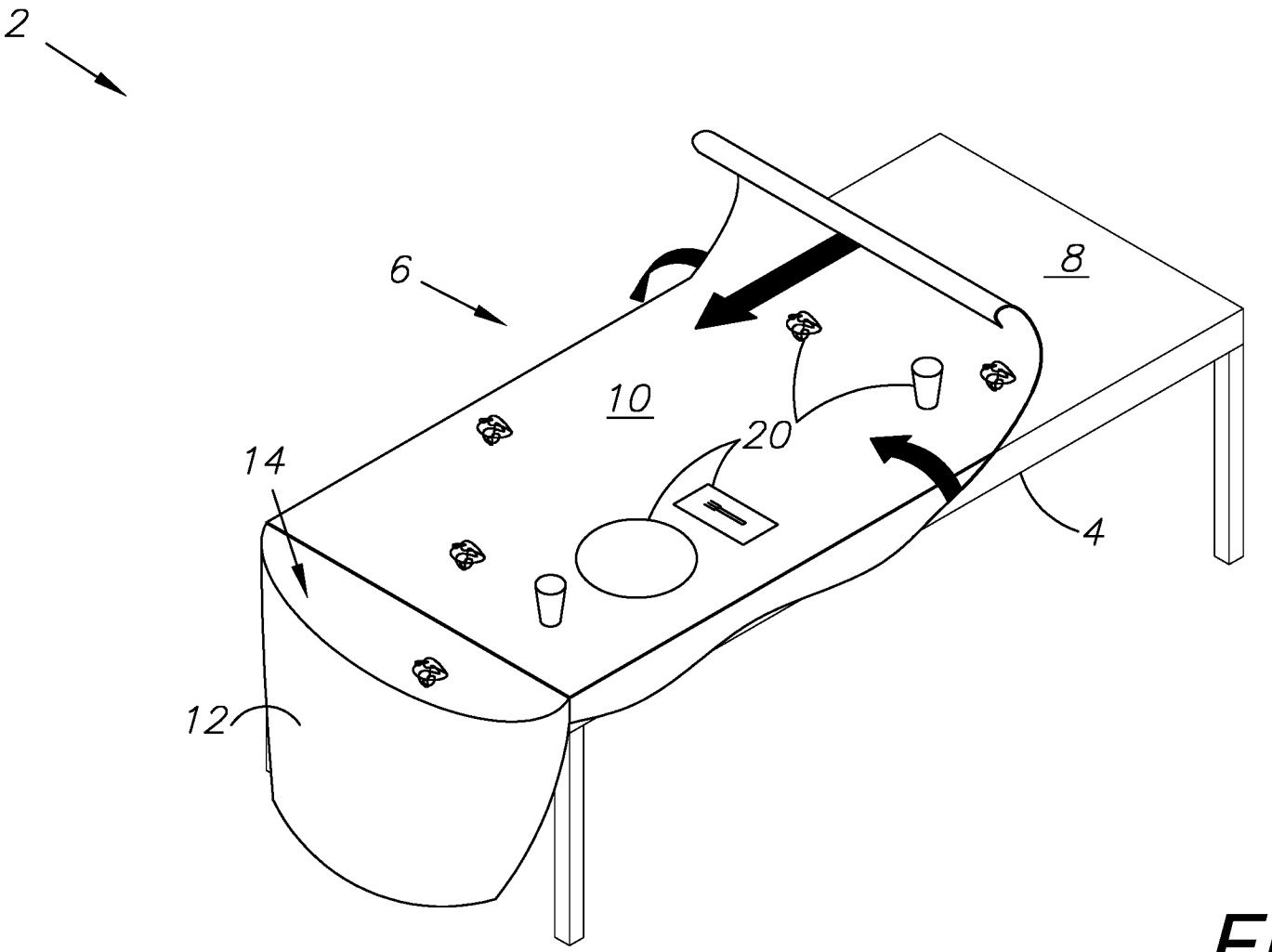
FIG. 4 is a three-dimensional isometric view thereof shown in a deployed orientation with the bag element deployed to one end and the cover element being removed toward the bag element.

FIG. 4 shows the cover 6 being removed and rolled toward the refuse bag 12 on the end of the table 4. Refuse 20 is captured within the cover element 6 as it is rolled toward the refuse bag 12 end of the table 4.

Figure 5:
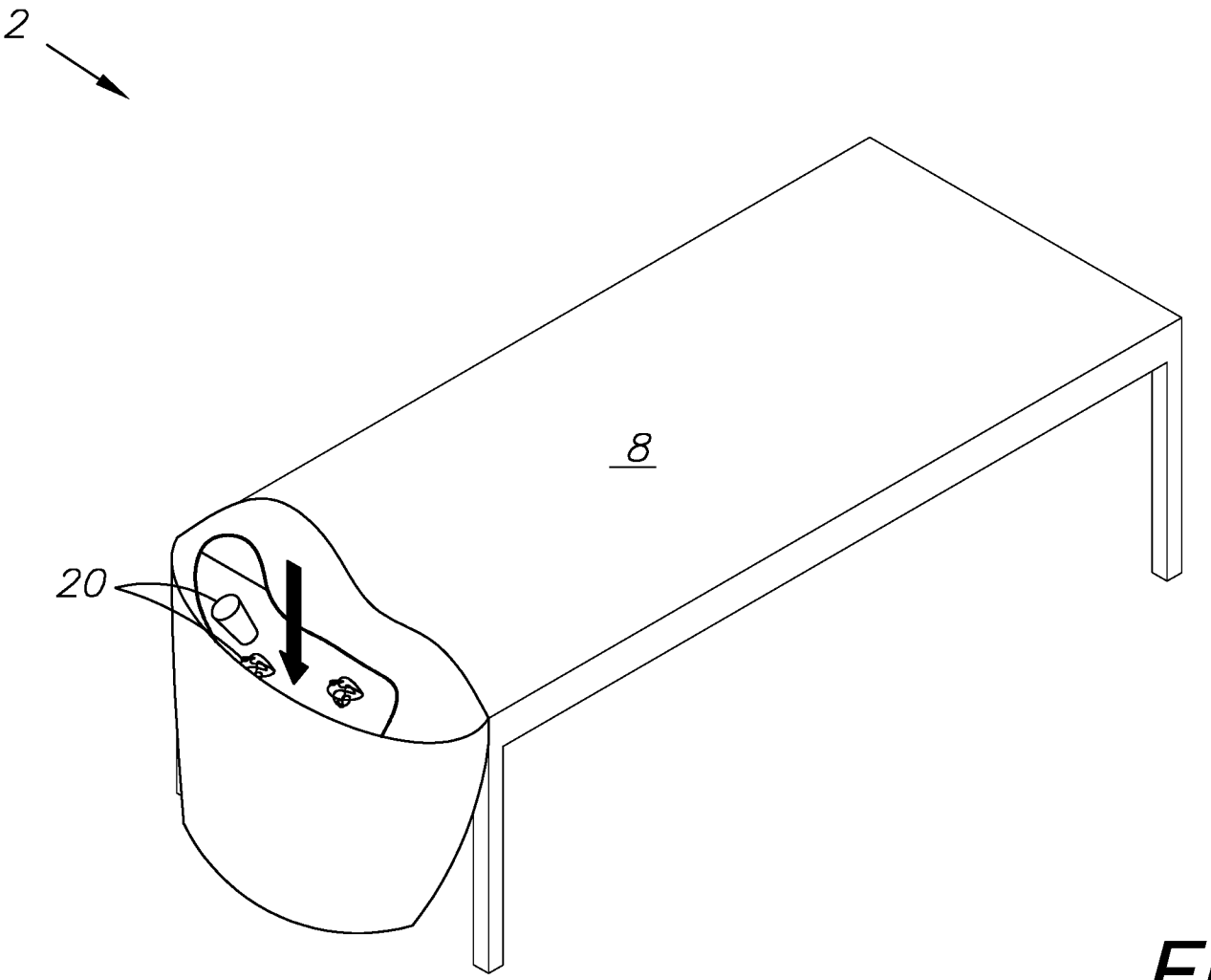
FIG. 5 is a three-dimensional isometric view thereof shown in a deployed orientation with the bag element deployed to one end and the cover element and rubbish being inserted into the bag element.
Figure 6:
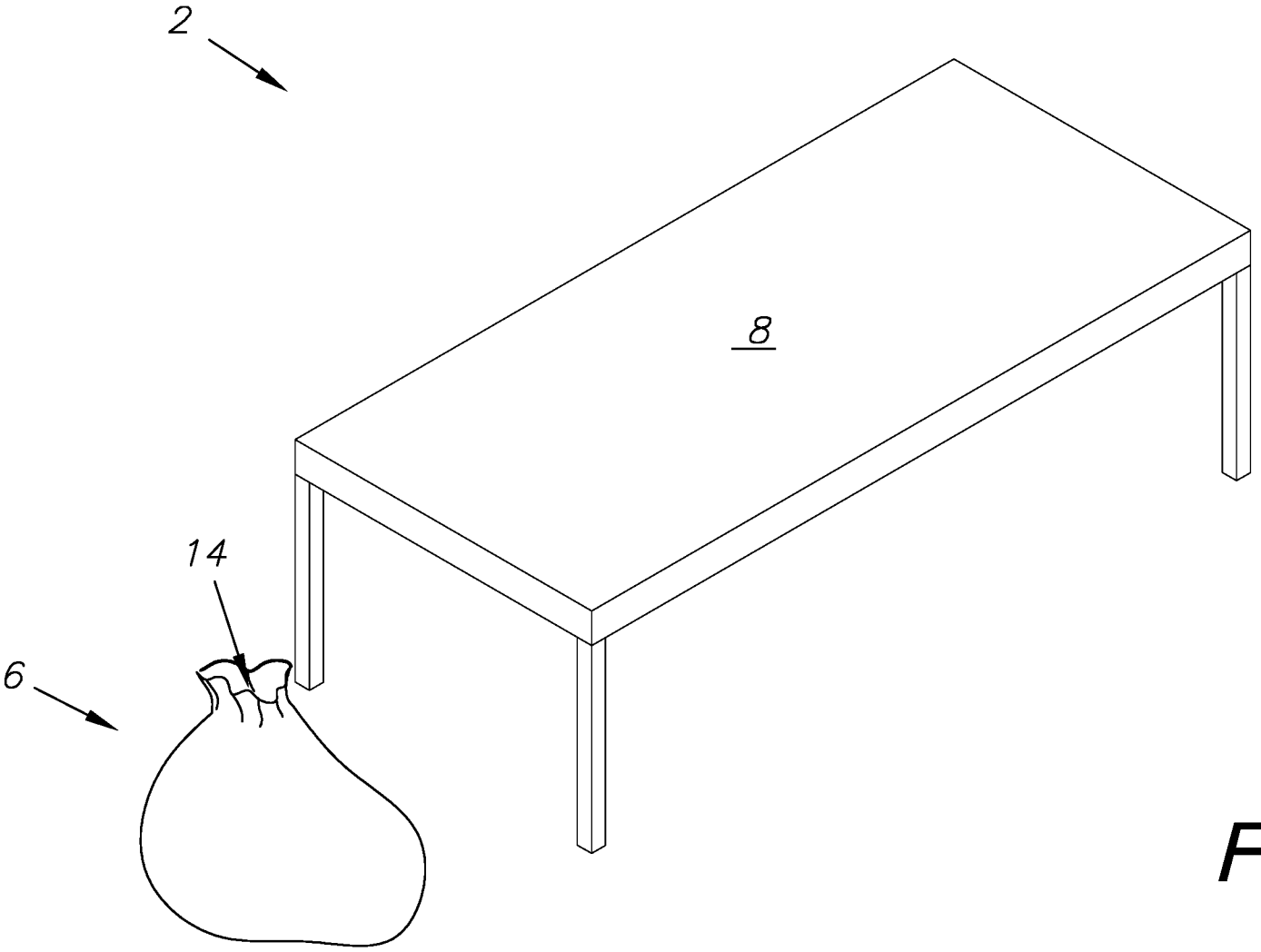
FIG. 6 is a three-dimensional isometric view thereof shown in a deployed orientation with the bag element shown in a closed and secured orientation.

FIG. 5 shows the cover 6 and refuse 20 being stuffed into the opening 14 of the refuse bag 12. FIG. 6 shows the refuse bag 12, after being filled with the cover 6 and refuse 20 being secured and closed for removal and disposal.

Figure 7:
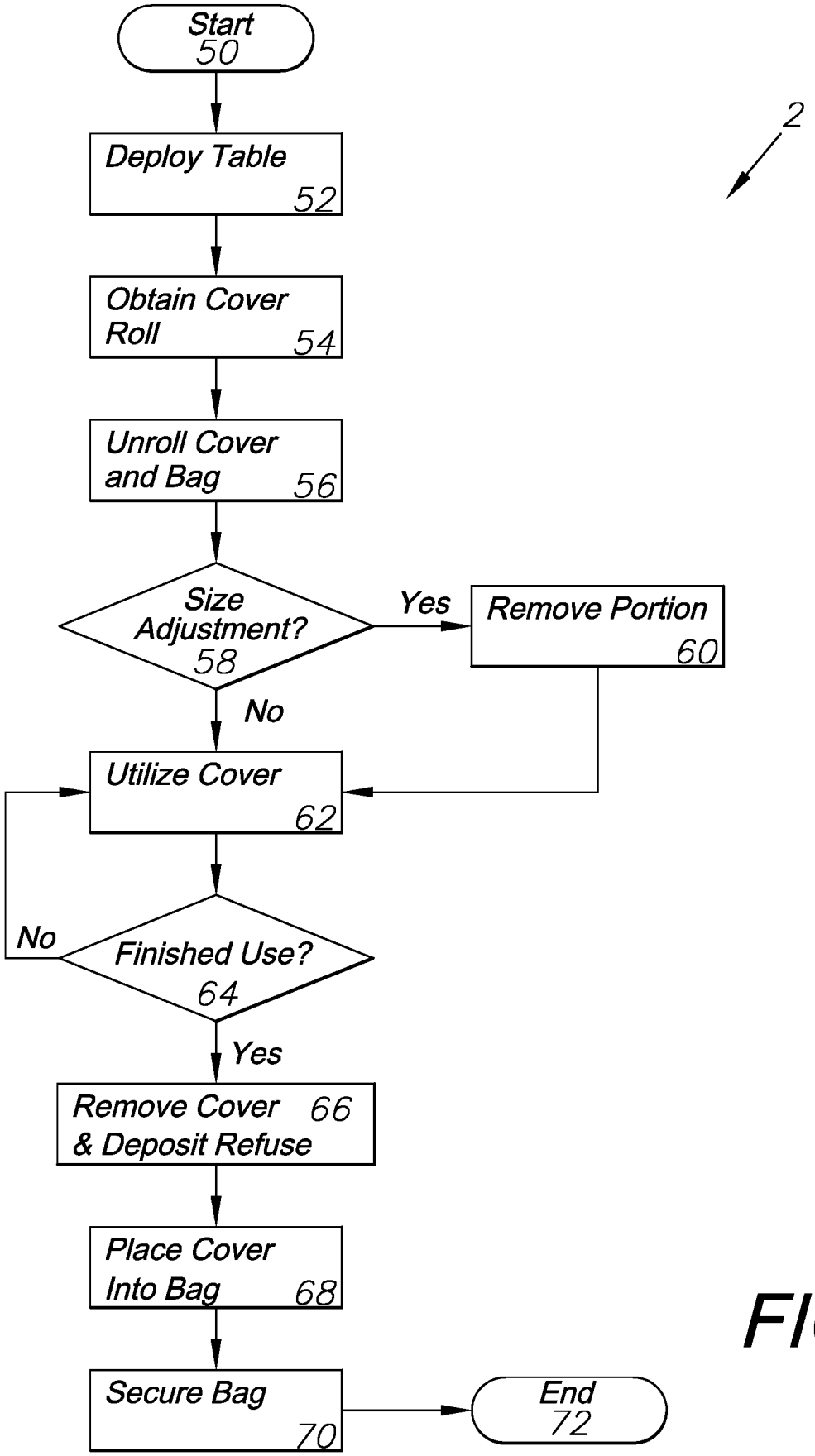
FIG. 7 is a flow chart diagramming steps taken in practicing an embodiment of the present invention.

FIG. 7 shows the steps taken in practicing an embodiment of the present invention. As shown in FIGS. 1-6, the process starts at 50, the table is positioned and deployed at 52, and a cover roll is obtained at 54. The cover roll is unrolled, along with the refuse bag, at 56. It should be noted that the roll could instead be a folded device that is unfolded and deployed onto the table.

If a size adjustment is determined to be needed at 58, a portion of the cover may be removed at 60, using scissors, perforations, or other removal means. Once the determination of whether a size adjustment is needed at 58, and such adjustment is made at 60, the cover is utilized at 62. As discussed above, games or other elements may be utilized on the surface of the cover, and dining items and other eventual refuse may be placed atop the cover and used. If the items are in further use at 64, the cover remains in place. If the use of the dining items and other items is determined to be finished at 64, the cover is removed and refuse is deposited into the bag at 66. The cover itself is also stuffed into the bag at 68, including all remaining refuse. The bag is secured at 70 and disposed of, and the process ends at 72.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A table cover system comprising:

a cover device comprising a table cover configured to be placed on top of a table surface, said cover device having a top surface, a first end, and a second end and a first side and a second side, wherein said first end and second end are of equal length and wherein said length of said first end and said second end is less than that of either said first side or said second side;

said first side, said second side, and said first end comprising overhanging flaps configured for securing said cover device to said top surface;

said second end of said cover device comprising a refuse bag, wherein said refuse bag is comprised of and permanently attached to the table cover and wherein said refuse bag encompasses the entirety of said length of said second end;

said refuse bag comprising an opening configured to receive refuse and said table cover;

wherein said cover device is transformable from a first, undeployed orientation to a second, deployed orientation atop a table with said refuse bag deployed about said second end of said table; and wherein said cover device is further transformable from said second, deployed orientation to a third, disposable orientation wherein said table cover is placed within said refuse bag.

2. The table cover system of claim 1, further comprising a plurality of decorative features located on said top surface of said table cover.

3. The table cover system of claim 2, wherein said decorative features comprise games.

4. The table cover system of claim 2, wherein said decorative features comprise trademarked logos.

5. The table cover system of claim 2, wherein said decorative features comprise three-dimensional elements.

6. The table cover system of claim 1, wherein said table cover is configured to receive dining items placed upon said top surface.

7. The table cover system of claim 1, wherein said table cover is configured to be selectively shortened.

8. The table cover system of claim 7, further comprising:

a plurality of perforations running through said table cover; and wherein said perforations are configured to allow said table cover to be selectively separated into a first portion and a second portion.

9. A method of deploying a table cover, the method comprising:

placing a table in a location;

providing a table cover device in a first, compact orientation and comprising a table cover and a refuse bag;

uncompacting said table cover device such that said table cover covers a top Ave of said table, said table cover having a first end, a second end, and a pair of sides, wherein said first end and said second end each have a first length, and said pair of sides having a second length, and wherein said first length is shorter than said second length;

deploying overhanging flaps from said first side, said second side, and said first end, said flaps configured to secure said table cover device to said top face of said table;

deploying said refuse bag to one end of said table, said refuse bag being affixed to and comprised of the same material as said table cover, along and encompassing the entire length of said second end;

placing disposable dining ware on said table cover;

discarding said disposable dining ware into said refuse bag;

packing up said table cover and moving said table cover into said refuse bag by rolling from said first end to said second end;

closing said refuse bag; and discarding said refuse bag.

10. The method of claim 9, wherein said table cover comprises a plurality of decorative features located on said top surface of said table cover.

11. The method of claim 10, wherein said decorative features comprise games.

12. The method of claim 10, wherein said decorative features comprise trademarked logos.

13. The method of claim 10, wherein said decorative features comprise three-dimensional elements.

14. The method of claim 9, further comprising the step:

selectively shortening said table cover to fit a length and width of said table top face.

15. The method of claim 14, further comprising the step:

separating said table cover along a perforation.

* * * * *